US007451801B2

(12) United States Patent
Park et al.

(10) Patent No.: US 7,451,801 B2
(45) Date of Patent: Nov. 18, 2008

(54) VERTICAL VANE SUPPORT CLIP FOR COVERINGS FOR ARCHITECTURAL OPENINGS

(75) Inventors: Jeffrey A. Park, Miami Beach, FL (US); Chris A. Rice, Boca Raton, FL (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 115 days.

(21) Appl. No.: 11/566,313

(22) Filed: Dec. 4, 2006

(65) Prior Publication Data

US 2007/0137800 A1 Jun. 21, 2007

Related U.S. Application Data

(60) Provisional application No. 60/752,330, filed on Dec. 20, 2005.

(51) Int. Cl.
*E06B 9/36* (2006.01)

(52) U.S. Cl. ..... 160/173 V; 160/178.1 V

(58) Field of Classification Search ..... 160/168.1 V, 160/173 V, 176.1 V, 177 V, 178.1 V
See application file for complete search history.

(56) References Cited

U.S. PATENT DOCUMENTS 4,053,009 A * 10/1977 Edlin ..... 160/348
4,922,986 A * 5/1990 Leibowitz ..... 160/178.1 V
6,131,243 A * 10/2000 Lee ..... 16/87.2
6,289,563 B1 * 9/2001 Watkins ..... 29/24.5
6,330,900 B1 * 12/2001 Welfonder ..... 160/178.1 V

* cited by examiner

*Primary Examiner*—Blair M. Johnson
(74) *Attorney, Agent, or Firm*—Dorsey & Whitney LLP

(57) ABSTRACT

A removable clip for suspending a vane in a vertical vane covering for an architectural opening from a carrier in a control system comprises a neck for connection to the carrier and spaced downwardly projecting fixed and movable legs having a system for releasable interconnection. The movable leg is connected to the necks of the clip through a living hinge so as to be pivotal about the hinge between open and closed position. In the open position, a vane having a hole adjacent to the top edge thereof can be inserted into the clip connection thereto. The neck of the clip has an opening therethrough for suspension from a hook or ledge on the carrier.

9 Claims, 6 Drawing Sheets

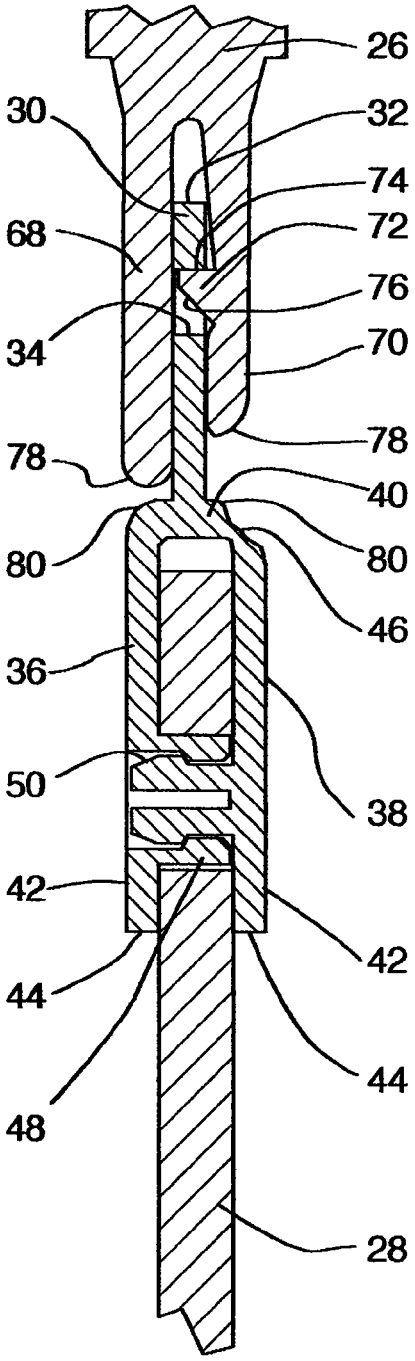
Fig. 4
Fig. 5
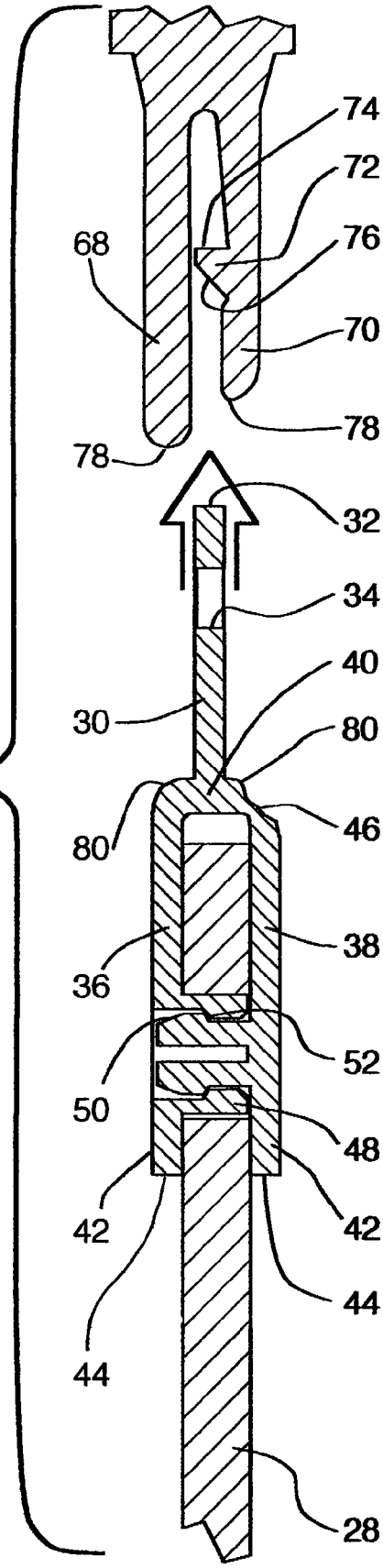

VERTICAL VANE SUPPORT CLIP FOR COVERINGS FOR ARCHITECTURAL OPENINGS

CROSS-REFERENCE TO RELATED APPLICATION

The present application claims the benefit under 35 U.S.C. § 119(e) to U.S. Provisional Patent Application No. 60/752,330 ("the '330 application"), which was filed on Dec. 20, 2005 and entitled "VERTICAL VANE SUPPORT CLIP FOR COVERINGS FOR ARCHITECTURAL OPENINGS." The '330 application is incorporated by reference into the present application in its entirety.

BACKGROUND OF THE INVENTION

1. Field of the Invention

The present invention relates generally to coverings for architectural openings and more particularly to a support clip for a vertical vane of a vertical vane type covering for architectural openings.

2. Description of the Relevant Art

Coverings for architectural openings such as windows, doors, archways and the like can assume numerous forms with many such forms being retractable. Examples of retractable coverings would include venetian blinds, vertical blinds, roller shades, cellular blinds and the like.

In the case of vertical blinds, a plurality of vertically extending vanes or slats are suspended from a headrail by associated carriers. The carriers are movable along the length of the headrail with a control cord or an electrically operated control system. The vanes or slats can thereby be desirably and selectively positioned along the length of the headrail when the covering is moved between extended and retracted positions. In an extended position, the vanes or slats are generally uniformly spaced relative to each other across the architectural opening. In the retracted position, they are horizontally stacked adjacent to one or both sides of the opening.

In addition, the slats or vanes can be rotated about their vertical longitudinal axes between open and close positions. In the open position, the vanes extend generally perpendicularly to the architectural opening and have a space there between through which vision and light can pass. In the closed position, they are positioned in a slightly overlapping, parallel relationship with each other and with the architectural opening.

Various systems have been employed for suspending vanes or slats from carriers so they move dependably with the carriers. The systems for suspension typically include some form of clip so that the carriers and slats which are interconnected with the clips move in uniformity.

SUMMARY OF THE INVENTION

The clip of the present invention for suspending vertical vanes from carriers of a vertical vane covering are made of a semi-rigid but somewhat pliant material with the clip being movable between open and closed positions. In the closed position, the clip resembles a yoke having an upstanding neck and depending legs that are spaced from each other, with one of the legs being fixed and the other movable about a living hinge.

One of the fixed and movable legs has a locking post while the other has a complimentary locking pin. The locking pin and post are selectively and releasably interconnectable to retain the clip in the closed position. In the open position, the locking post and locking pin are disengaged with the movable leg being pivotably separated from the fixed leg to facilitate a connection of the clip to a vane.

The neck of the clip has an opening therein for releasable connection with a carrier pin suspended from the headrail of the covering in a manner such that the neck can be easily connected or removed from an associated carrier while the depending legs are easily connected to or removed from a suspended vane.

Other aspects, features and details of the present invention can be more completely understood by reference to the following detailed description of a preferred embodiment, taken in conjunction with the drawings and from the appended claims.

BRIEF DESCRIPTION OF THE DRAWINGS

FIG. 4 is an enlarged fragmentary section taken along line 4-4 of FIG. 2.

FIG. 5 is a section similar to FIG. 4 with the clip separated from its associated carrier.

DETAILED DESCRIPTION OF THE PREFERRED EMBODIMENT

Figure 1:
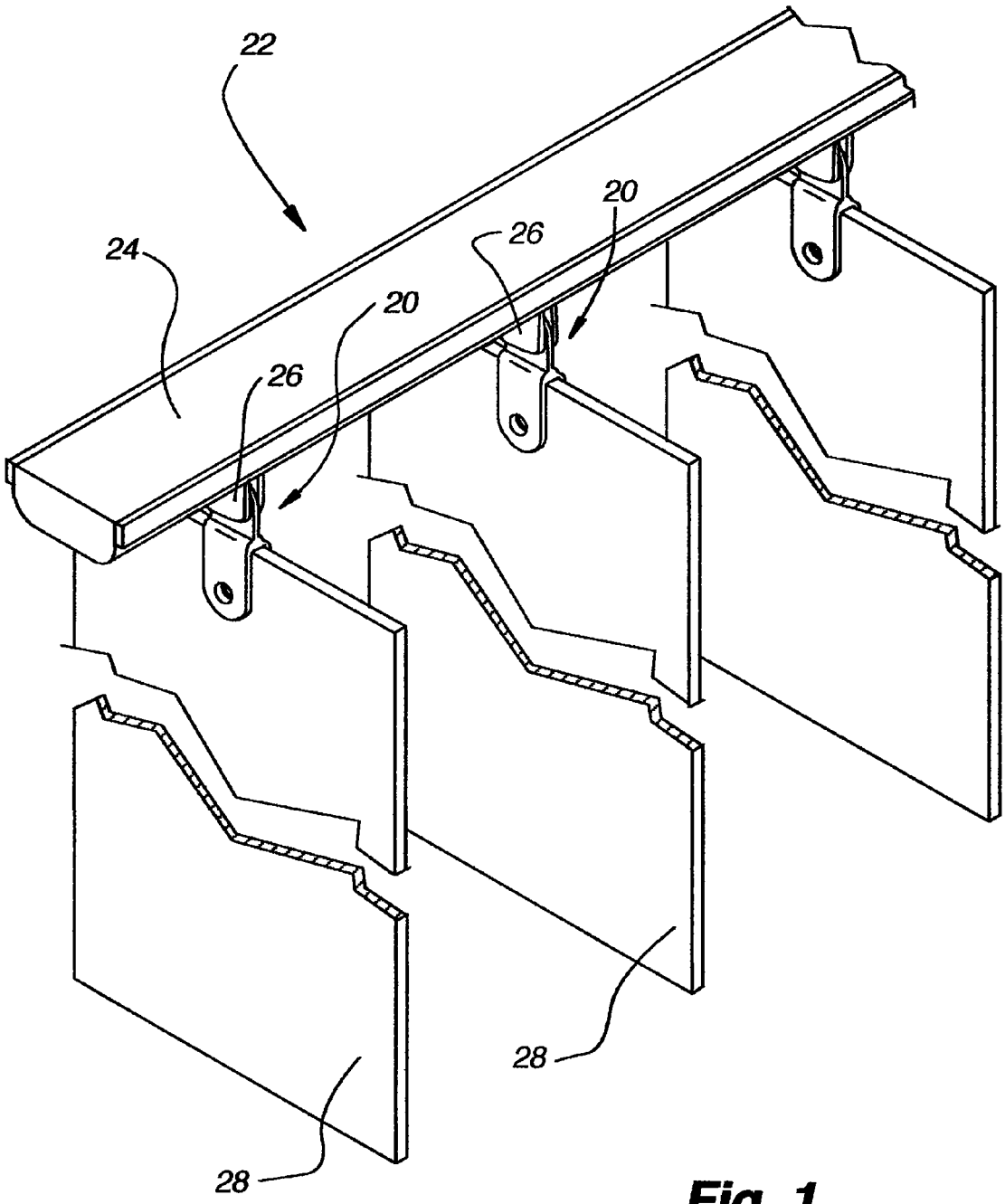
FIG. 1 is a fragmentary isometric showing a headrail for a covering for an architectural opening having carriers suspended therefrom and interconnected with an associated vane of the covering with a clip of the present invention.
Figure 3:
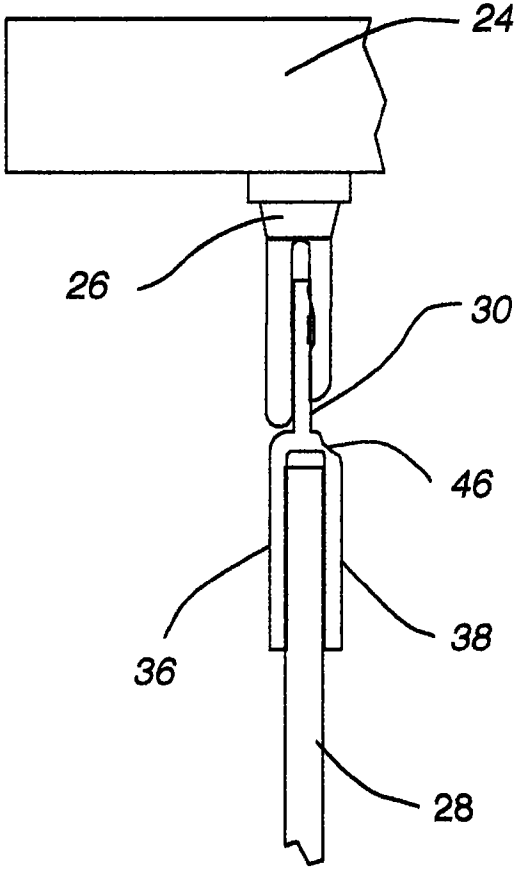
FIG. 3 is a right side elevation of the clip as illustrated in FIG. 2.
Figure 2:
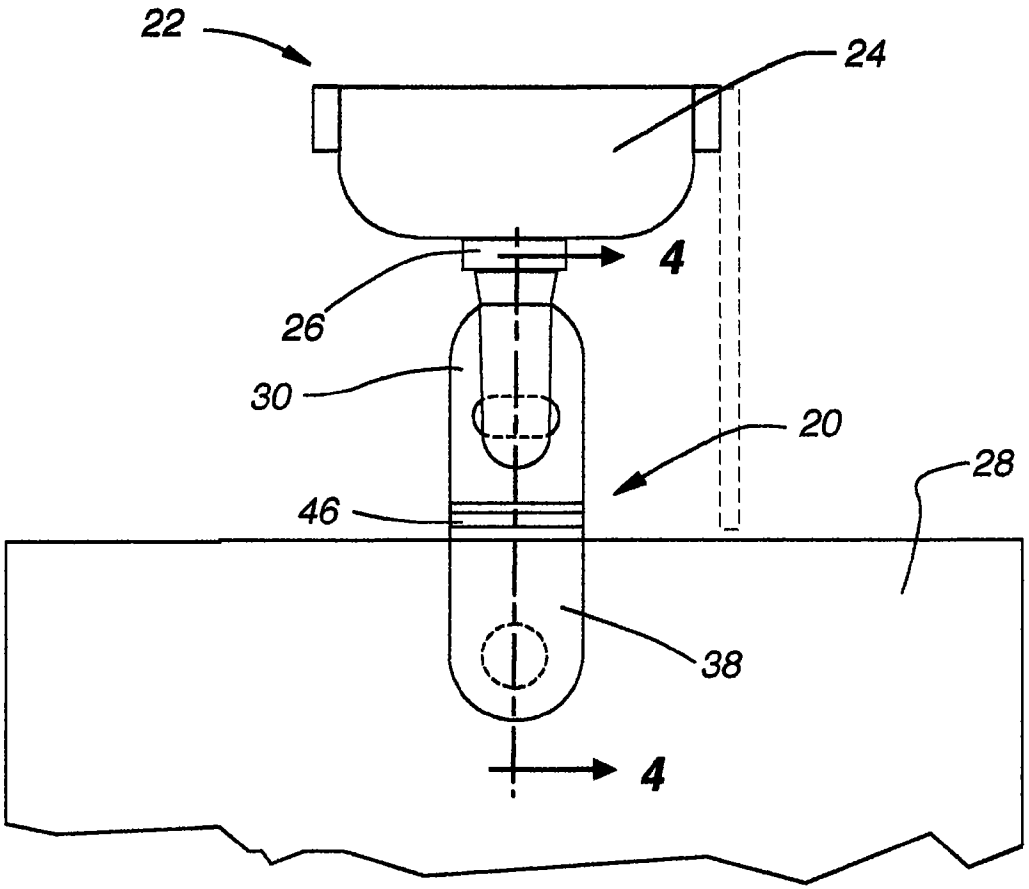
FIG. 2 is a fragmentary elevation showing the top of a vane and its interconnection with a carrier by the clip of the present invention.
Figure 6:
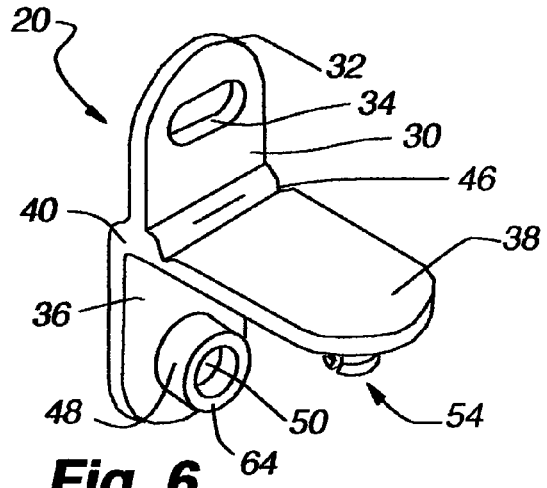
FIG. 6 is an isometric of the clip of the invention in an open position.
Figure 7:
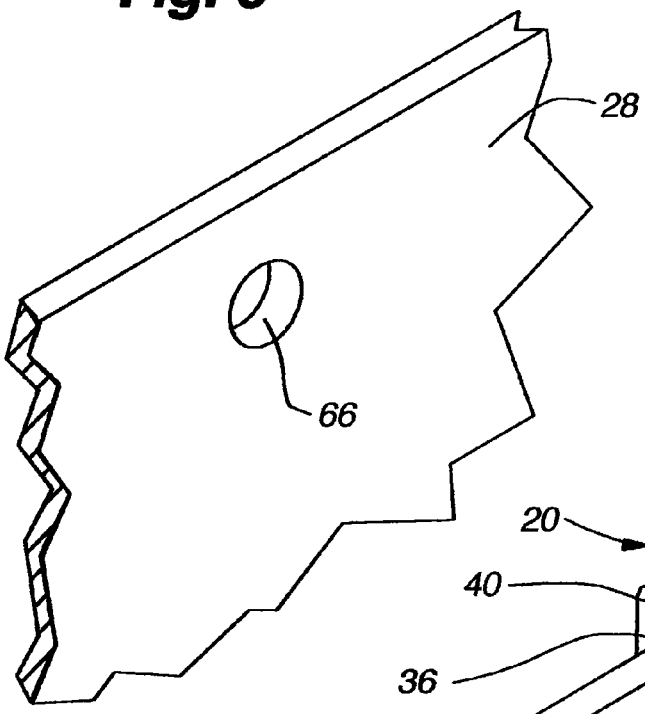
FIG. 7 is a fragmentary isometric of the top of a vane to be suspended from the clip.

The clip 20 of the present invention is shown incorporated into a vertical vane covering 22 for an architectural opening (not shown) in FIG. 1. The vertical vane covering is seen to include not only the clip but also a headrail 24 having a plurality of depending carriers 26 and a plurality of vertical vanes or slats 28. The headrail also incorporates a control system (not seen) which is operated by a pull cord, electric motor or the like to move the carriers between the extended position shown in FIG. 1 and a retracted position wherein the carriers are immediately adjacent or contiguous with each other and horizontally stacked in one or more stacks. The retracted position of the covering is not shown even though it is conventional in the art of vertical vane coverings to have carriers that are movable along the length of the headrail between extended and retracted positions as described. In addition, the control system is adapted to pivot the carriers about vertical axes. The headrail, carriers and control system in addition to the vanes, are included in the disclosure for illustrative purposes only and could take numerous forms well known in the art. For example, vanes in the present disclosure are shown as flat wooden vanes but could be plastic, arcuate, tubular or one of various configurations or materials known in the art.

With reference to FIGS. 6 and 12-14, the clip 20 of the invention can be seen to include a vertical plate like neck 30 having a arcuate top edge 32 and an ovular opening 34 therethrough and fixed 36 and movable legs 38 which are adjoined to the neck along a juncture block 40. Each leg is similarly structured having a flat plate like body 42 and an arcuate lower edge 44 but the movable leg 38 is connected at the juncture block 40 with a living hinge 46 defined by a relatively thin line of connection. The clip is preferably made of a semi-rigid somewhat pliant material that will retain its shape but can be slightly deformed with enough pressure and can be readily flexed if the thickness of the material is thin enough as along the living hinge 46. Samples of such materials would be polyethylene, polycarbonate, polypropylene, polyurethane or other suitable plastics or metals.

Figure 11:
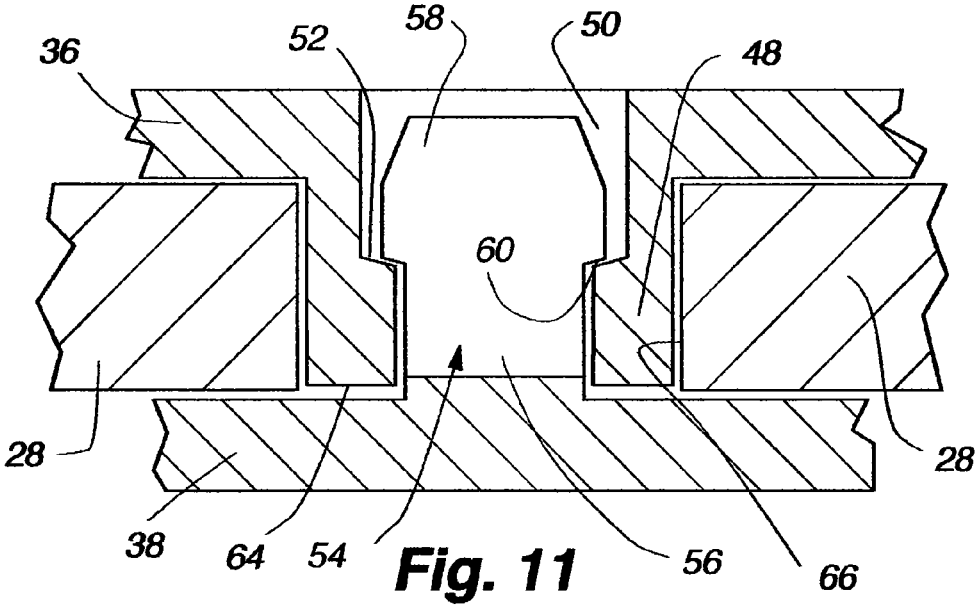
FIG. 11 is a section taken along line 11-11 of FIG. 10.
Figure 14:
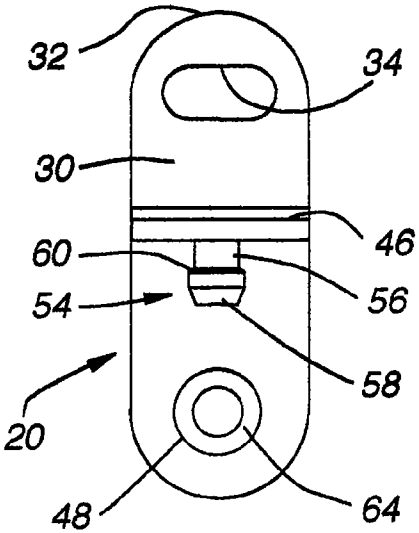
FIG. 14 is a front elevation of the clip.
Figure 13:
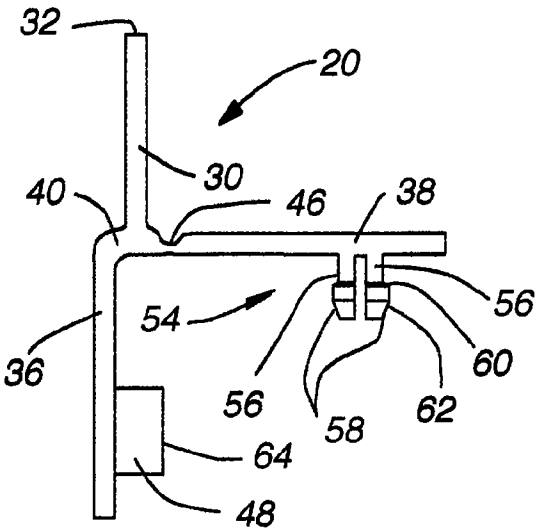
FIG. 13 is a side elevation of the clip.
Figure 12:
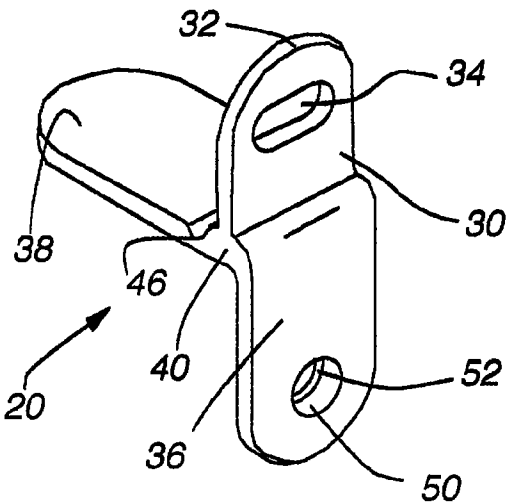
FIG. 12 is an isometric looking at the reverse side of the clip from that shown in FIG. 6.

The fixed leg 36 has a locking post 48 of generally cylindrical configuration projecting from an inner face with the locking post as best seen in FIG. 11 defining an inner cavity 50 with a peripheral, slightly beveled shelf 52 for a purpose to be described hereafter.

The movable leg 38 has a locking pin 54 projecting off its inner surface in alignment with the locking post 48 on the fixed leg when the legs are confronting. The pin is adapted to be releasably secured within the locking post. As probably best appreciated by reference to FIGS. 11, 13 and 14, the locking pin is defined by two circumferentially spaced legs 56 each having an enlarged head 58 on its distal end with a beveled lip 60 and a beveled surface 62. Each of the two legs are somewhat resilient due to the material from which the clip 20 is made so that the locking pin can be inserted into the locking post and releasably retained therein. When the locking pin is inserted into the locking post, the beveled surfaces 62 of the legs engage a circumferential edge 64 of the locking post compressing the legs toward each other so that the enlarged heads 58 fit into the lock post and will snap outwardly once the enlarged heads are received within the large cavity 50 in the locking post. The beveled lips 60 of each leg of the locking pin are received on the peripheral beveled shelf 52 of the locking post to retain the pin within the post. Due to the resiliency of the material from which the clip is made and the beveled surfaces 52 and 60, however, by prying the movable leg 38 away from the fixed leg 36 the locking pin will snap out of the locking post so that the clip can be moved from its closed position of FIG. 9 to the open position of FIG. 6.

Regardless of whether or not the clip 20 is open or closed 30, the neck lies in a plane parallel with the fixed leg 36 and the movable leg 38 is pivotal about the living hinge 46. When the movable leg is in the closed position of FIG. 9, it is parallel with both the fixed leg and the neck.

Figure 8:
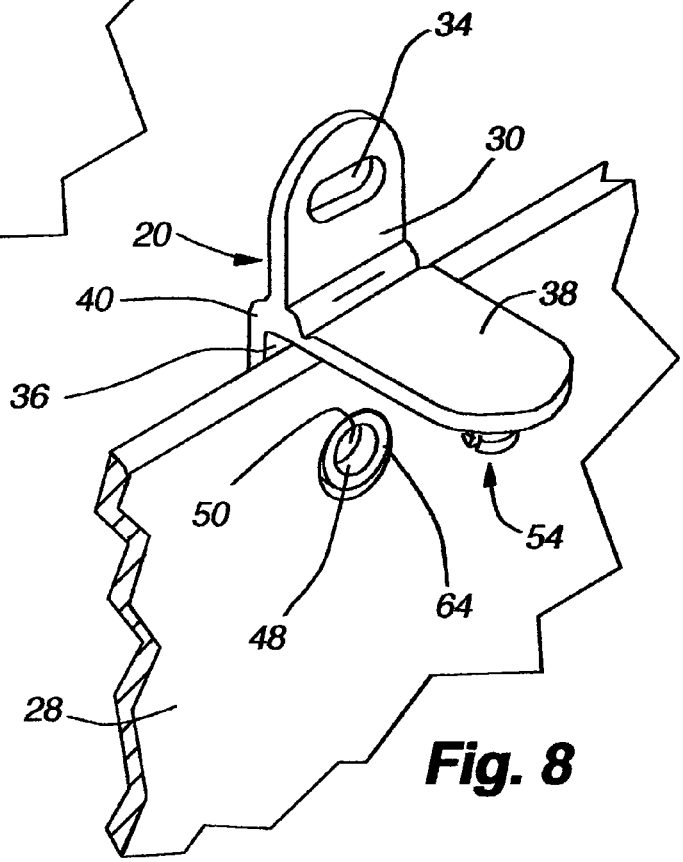
FIG. 8 is a fragmentary isometric similar to FIG. 7 with the clip positioned on the vane but in an open position.
Figure 9:
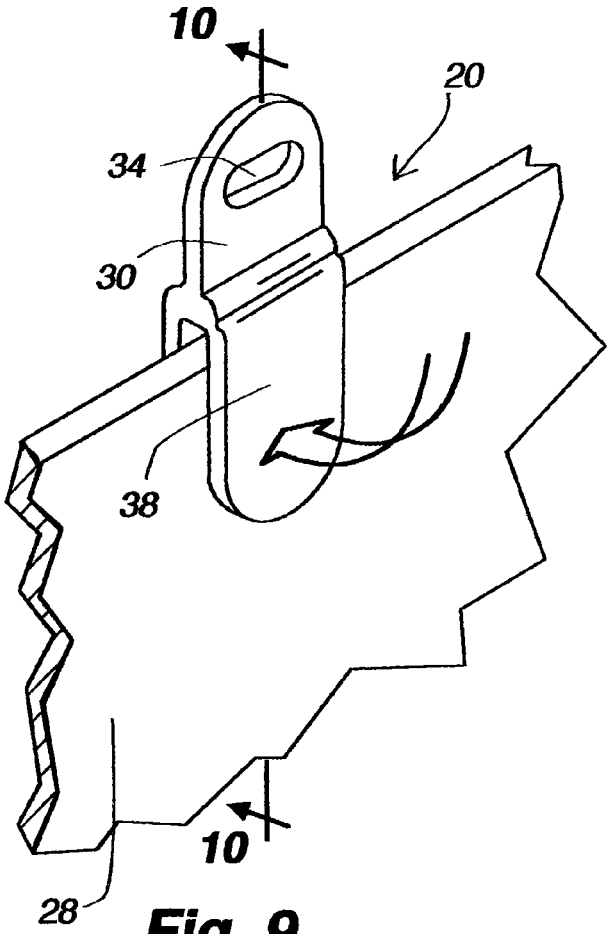
FIG. 9 is a fragmentary isometric similar to FIG. 8 with the clip in a closed position.
Figure 10:
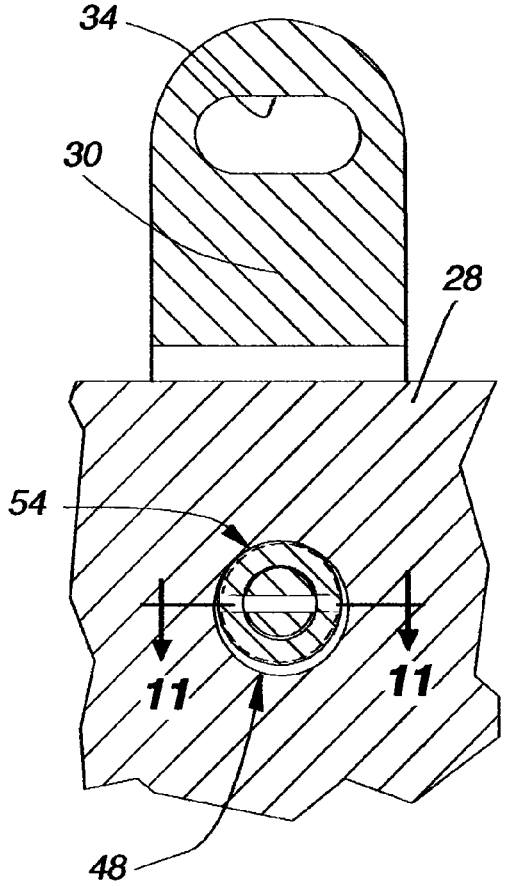
FIG. 10 is an enlarged section taken along line 10-10 of FIG. 9.

When mounting the clip 20 on the top of a vane 28, a circular hole 66 is formed at a spaced location from the top edge of the vane and of a size slightly larger than the outer diameter of the locking post 48. The vane is of a predetermined thickness and the clip is designed so that the spacing between the fixed 36 and movable 38 legs when in the closed position is slightly greater than the thickness of the vane so that the vane is free to move within limits relative to the clip. Once the locking post has been inserted into the hole 66 in the vane as shown in FIG. 8, the movable leg is pivoted downwardly as shown in FIG. 9 until the locking pin 54 is snapped into its releasable connection with the locking post 48 as shown in FIGS. 10 and 11.

The neck 30 of the clip 20 is adapted to be releasably suspended from a carrier 26 so it is important that the carrier have a hook, ledge or some system for being interconnected with the clip. While carriers can take numerous forms, for purposes of the present disclosure, the carrier as best illustrated in FIGS. 4 and 5, has a long 68 and short 70 depending leg that are spaced from each other a distance slightly greater than the thickness of the neck of the clip. The shorter leg 70 has an inward protrusion 72 defining an upper seat 74 and a lower beveled surface 76 so that the neck of the clip can be inserted into the space between the long and short legs as shown in FIG. 5 until the protrusion snaps into the ovular opening 34 in the neck as shown in FIG. 4. The fit between the carrier and the clip is a loose one so that the clip will easily pivot and can be moved minimal amounts whereby gravity acting upon the clip through the connected vane 28 will allow the vane to be suspended vertically rather than at an angle. In this manner, all the vanes are suspended uniformly for aesthetics of the covering.

To remove the clip 20 from the carrier 26, it will be appreciated the lower edges 78 of both the long and short legs of the carrier are rounded and the juncture block 40 of the clip has rounded upper edges 80 so that one of the rounded upper edges of the juncture block, upon upward movement of the clip, will engage the rounded lower edge of the longer leg, camming the leg outwardly to spread the longer leg further to allow the clip to be released from the protrusion 72. The bottom of the ovular opening 34 also engages the beveled surface 76 of the carrier to encourage the legs to spread in permitting removal of the clip from the carrier.

Figure 15:
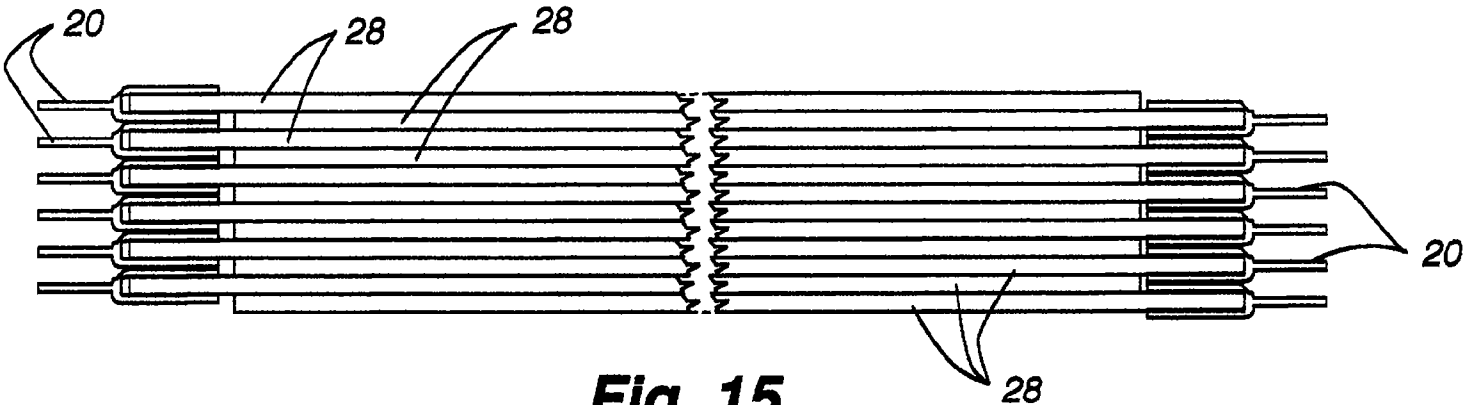
FIG. 15 is a side elevation of a plurality of vanes connected to clips of the present invention and stacked vertically for example for shipping purposes.

With reference to FIG. 15, vanes 28 having clips 20 connected thereto can be neatly stacked for transportation before being incorporated into a covering for an architectural opening by alternating the direction of the vane so that the lowermost vane in the stack, for example, has its support clip 20 facing in one direction and the next lowermost vane has its connected clip projecting in an opposite direction.

Although the present invention has been described with a certain degree of particularity, it is understood the disclosure has been made by way of example and changes in detail or structure may be made without departing from the spirit of the invention as defined in the appended claims.

The invention claimed is:

1. A covering for an architectural opening comprising in combination;

a control system including a plurality of carriers for suspending vertically oriented vanes, a plurality of vertically oriented vanes, and a unitary semi-rigid clip for connecting a vane to a carrier, said clip including a neck mounted on a juncture block with means on the neck for connecting the clip to a carrier and a fixed and movable leg depending from said juncture block, said fixed leg being substantially immovable relative to said juncture block and said moveable leg being and wherein pivotally connected to said juncture block with a living hinge and wherein said legs include a connection system for connecting the clip to a vane.

2. The covering of claim 1 wherein said movable leg is movable between a closed position in spaced substantially parallel relationship with said fixed leg and an open position in non-parallel relationship with said fixed leg.

3. The covering of claim 1 wherein said connection system includes a locking member on one of said legs and a complementary locking member on the other of said legs.

4. The covering of claim 3 wherein said locking member and complementary locking member are releasably lockable together.

5. The covering of claim 3 wherein said locking member is a locking post and said complementary locking member is a resilient locking pin.

6. The covering of claim 5 wherein said locking post includes a releasably interlocking hole and said locking pin is insertable into said hole.

7. The covering of claim 1 wherein said means for connecting comprises a hole through said neck.

8. The covering of claim 1 wherein said clip is made of a plastic material.

9. The covering of claim 8 wherein said plastic material is polypropylene.

* * * * *

UNITED STATES PATENT AND TRADEMARK OFFICE

CERTIFICATE OF CORRECTION

PATENT NO. : 7,451,801 B2
APPLICATION NO. : 11/566313
DATED : November 18, 2008
INVENTOR(S) : Jeffrey A. Park et al.

It is certified that error appears in the above-identified patent and that said Letters Patent is hereby corrected as shown below:

Column 4, line 58, delete “and wherein”; and

Column 4, line 59, after “a”, second occurrence, insert --releasably interlocking--.

Signed and Sealed this

Sixth Day of January, 2009

JON W. DUDAS
*Director of the United States Patent and Trademark Office*